US009809288B1

(12) United States Patent
Newhard

(10) Patent No.: US 9,809,288 B1
(45) Date of Patent: Nov. 7, 2017

(54) OAR-CARRYING DEVICE

(71) Applicant: Richard Newhard, North Plainfield, NJ (US)

(72) Inventor: Richard Newhard, North Plainfield, NJ (US)

( * ) Notice: Subject to any disclaimer, the term of this patent is extended or adjusted under 35 U.S.C. 154(b) by 0 days.

(21) Appl. No.: 15/181,547

(22) Filed: Jun. 14, 2016

(51) Int. Cl.
*A45F 5/10* (2006.01)
*A45F 5/14* (2006.01)
*B63H 16/04* (2006.01)

(52) U.S. Cl.
CPC ..... *B63H 16/04* (2013.01)

(58) Field of Classification Search
CPC ..... B63H 16/04
USPC ..... 294/147, 150, 153, 154, 155, 152, 157, 294/162, 165; 114/347; 440/104
See application file for complete search history.

(56) References Cited

U.S. PATENT DOCUMENTS 85,129 A * 12/1868 Porter ..... A45F 5/10 294/154
123,525 A * 2/1872 Topham ..... A45F 5/10 294/154
154,283 A * 8/1874 Roemer ..... A45F 5/10 294/154
164,994 A * 6/1875 Harrel ..... A45F 5/10 294/154
206,928 A * 8/1878 Butler ..... A45F 5/10 294/154
208,126 A * 9/1878 Streeter ..... A45F 5/10 294/150
303,896 A * 8/1884 Tharp ..... A45F 5/10 294/154
448,657 A * 3/1891 Loveless ..... A45F 5/10 294/150
473,566 A * 4/1892 Caplis ..... A45F 5/10 294/155
2,919,017 A * 12/1959 Weber ..... A45C 7/0031 206/315.11
2,973,989 A * 3/1961 Harwood ..... A45F 5/10 215/396
2,978,154 A * 4/1961 Kailey ..... A45F 5/10 294/154
3,106,410 A * 10/1963 Walter ..... B60G 17/005 280/755
4,114,838 A * 9/1978 Knauf ..... A45F 5/00 224/917
4,120,437 A * 10/1978 Hara ..... A63C 11/025 24/306
4,453,490 A * 6/1984 Miller ..... B63H 16/04 114/364
4,724,989 A 2/1988 Silberberg
4,804,025 A 2/1989 Bear
D320,696 S 10/1991 Butler
(Continued)

FOREIGN PATENT DOCUMENTS

CA 2258478 A1 7/2000

*Primary Examiner* — Paul T Chin

(57) ABSTRACT

The oar-carrying device is adapted for use with one or more oars used in sculling or rowing. The oar-carrying device comprises an arcuate shaft to which one or more oars are attached thus allowing the one or more oars to be carried in a controlled manner. The arcuate shaft further comprises a plurality of fasteners that attach the one or more oars to the arcuate shaft. The oar-carrying device comprises an arcuate shaft, a plurality of oar plates and a plurality of fasteners.

8 Claims, 2 Drawing Sheets

(56) References Cited

U.S. PATENT DOCUMENTS

| | | | | |
|---|---|---|---|---|
| 5,059,145 | A * | 10/1991 | Gregg | B63H 16/04<br>114/347 |
| 5,104,017 | A | 4/1992 | Vandagriff | |
| 6,944,911 | B2 * | 9/2005 | Knoblauch | A01K 97/08<br>16/114.1 |
| 8,616,600 | B2 | 12/2013 | Owen | |
| 9,193,428 | B2 | 11/2015 | Reed et al. | |

* cited by examiner

OAR-CARRYING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of vessels and floating structures, more specifically, an accessory configured for use with the oars associated with a sculling vessel.

SUMMARY OF INVENTION

The oar-carrying device is adapted for use with one or more oars used in sculling or rowing. The oar-carrying device comprises an arcuate shaft to which one or more oars are attached thus allowing the one or more oars to be carried in a controlled manner. The arcuate shaft further comprises a plurality of fasteners that attach the one or more oars to the arcuate shaft.

These together with additional objects, features and advantages of the oar-carrying device will be readily apparent to those of ordinary skill in the art upon reading the following detailed description of the presently preferred, but nonetheless illustrative, embodiments when taken in conjunction with the accompanying drawings.

In this respect, before explaining the current embodiments of the oar-carrying device in detail, it is to be understood that the oar-carrying device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the oar-carrying device.

It is therefore important that the claims be regarded as including such equivalent construction insofar as they do not depart from the spirit and scope of the oar-carrying device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
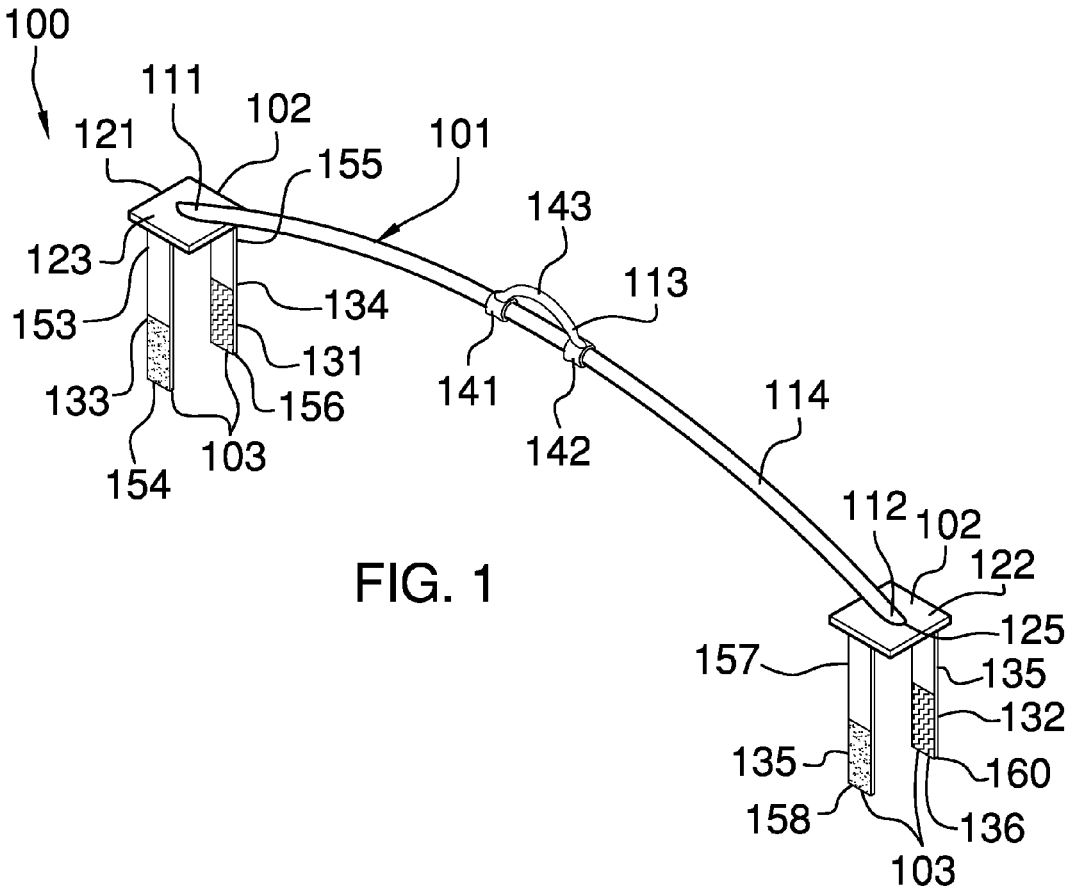
FIG. 1 is a perspective view of an embodiment of the disclosure.
Figure 2:
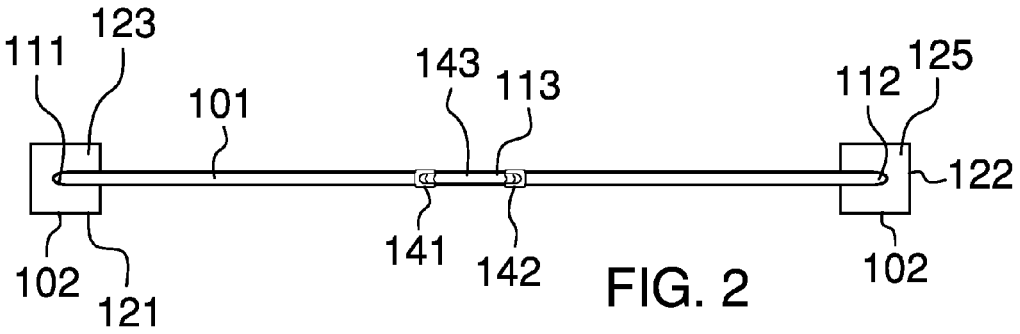
FIG. 2 is a top view of an embodiment of the disclosure.
Figure 3:
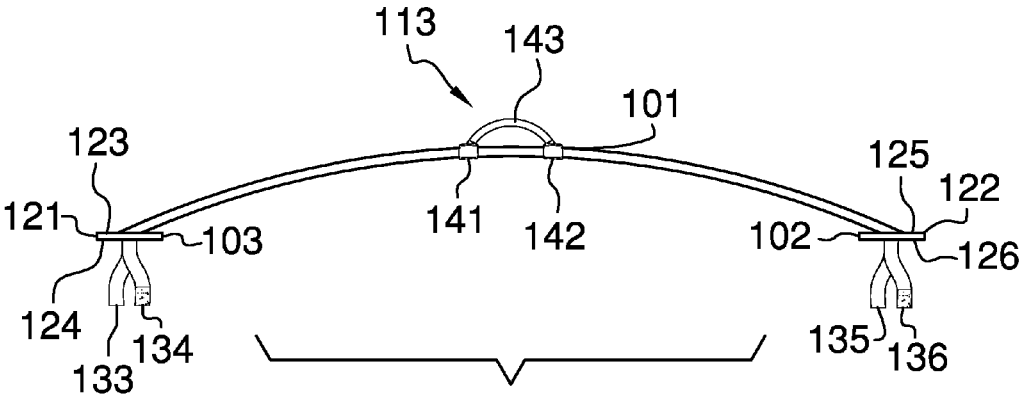
FIG. 3 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The oar-carrying device 100 (hereinafter invention) comprises an arcuate shaft 101, a plurality of oar plates 102 and a plurality of fasteners 103. The invention 100 is adapted for use with one or more oars 161 used in sculling or rowing. The invention 100 comprises an arcuate shaft 101 to which one or more oars 161 are attached thus allowing the one or more oars 161 to be carried in a controlled manner. The arcuate shaft 101 further comprises the plurality of fasteners 103 that attach the one or more oars 161 to the arcuate shaft 101.

The arcuate shaft 101 further comprises a curved bar 114 and a handle 113. The arcuate shaft 101 is further defined with a first end 111 and a second end 112. The first end 111 of the arcuate shaft 101 is formed with a first bevel. The second end 112 of the arcuate shaft 101 is formed with a second bevel. The arcuate shaft 101 is a cylindrical or tubular device that has a curvature formed in it much like the curvature found in a bow used for archery. The curvature of the arcuate shaft 101 forms a spring like device that absorbs bumps and other displacements of the one or more oars 161 during transport. This spring like action improves the control of the one or more oars 161 during transport.

The arcuate shaft 101 further comprises a handle 113 that is located at the center of the arcuate shaft 101. As shown most clearly on FIG. 3, the handle 113 further comprises a first tube 141, a second tube 142, and a grip 143. The first tube 141 and the second tube 142 are slid over the arcuate shaft 101. The grip 143 is attached to the first tube 141 and the second tube 142 such that the grip 143 forms a device that can be grasped by a hand such that the invention 100 can be carried and manipulated.

The plurality of oar plates 102 comprises a first oar plate 121 and a second oar plate 122. The first oar plate 121 is a rectangular structure that is further defined with a first surface 123 and a second surface 124. The second oar plate 122 is a rectangular structure that is further defined with a third surface 125 and a fourth surface 126. The first end 111 of the arcuate shaft 101 is attached to the center of the first surface 123 such that the face formed by the first bevel of the first end 111 is attached to the first surface 123. The second end 112 of the arcuate shaft 101 is attached to the center of the third surface 125 such that the face formed by the second bevel of the second end 112 is attached to the third surface 125.

Each of the plurality of fasteners 103 is used to attach the one or more oars 161 to an oar plate selected from the plurality of oar plates 102. The plurality of fasteners 103 further comprises a first fastener 131 and a second fastener 132. In the first potential embodiment of the disclosure, each of the plurality of fasteners 103 is a hook and loop fastener. The first fastener 131 further comprises a first hook or loop surface 133 and a second hook or loop surface 134. The first hook or loop surface 133 is further defined with a third end 153 and a fourth end 154. The second hook or loop surface 134 is further defined with a fifth end 155 and a sixth end 156. The third end 153 is attached to the second surface 124 of the first oar plate 121. The fourth end 154 hangs free. The fifth end 155 is attached to the second surface 124 of the first oar plate 121. The sixth end 156 hangs free. The second fastener 132 further comprises a third hook or loop surface 135 and a fourth hook or loop surface 136. The third hook or loop surface 135 is further defined with a seventh end 157 and an eighth end 158. The fourth hook or loop surface 136 is further defined with a ninth end 159 and a tenth end 160. The seventh end 157 is attached to the fourth surface 126 of the first oar plate 121. The eighth end 158 hangs free. The ninth end 159 is attached to the fourth surface 126 of the first oar plate 121. The tenth end 160 hangs free.

Figure 4:
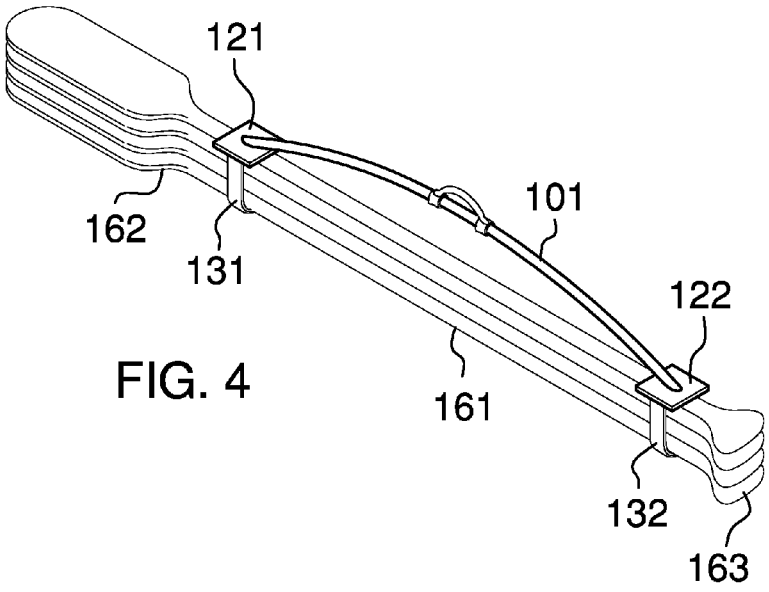
FIG. 4 is an in use view of an embodiment of the disclosure.

As shown most clearly in FIG. 4, to attach the one or more oars 161 to the invention 100, the one or more oars 161 are stacked such that the center axis of each oar selected from the one or more oars 161 is parallel the center axis of the oars remaining in the one or more oars 161. The one or more oars 161 are then positioned such that the eleventh end 162 of each of the one or more oars 161 is positioned underneath the second surface 124 of the first oar plate 121 and the twelfth end 163 of each of the one or more oars 161 is positioned underneath the fourth surface 126 of the second oar plate 122. The first hook or loop surface 133 and the second hook or loop surface 134 are then wrapped around the eleventh end 162 of each of the one or more oars 161 and pressed together to secure the one or more oars 161 to the first oar plate 121.

The third hook or loop surface 135 and the fourth hook or loop surface 136 are then wrapped around the twelfth end 163 of each of the one or more oars 161 and pressed together to secure the one or more oars 161 to the second oar plate 122. The one or more oars 161 can then be carried using the handle 113 of the arcuate shaft 101.

In the first potential embodiment of the disclosure, the arcuate shaft 101, including the handle 113, and the plurality of oar plates 102 are formed as a two units of molded plastic. A threaded connection is formed in the arcuate shaft 101 to allow the two units to be joined together. Suitable plastics include, but are not limited to, polyvinylchloride and high-density polyethylene. The selected plastic material and the final designed displacement volume of the arcuate shaft 101 and the plurality of oar plates 102 are selected such that the invention 100 will float.

The following definitions were used in this disclosure:

Arcuate: As used in this disclosure, arcuate describes the curve formed by a bent bow.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Fastener: As used in this disclosure, fastener a device that is used to join or affix two objects. Fasteners generally comprise a first element, which is attached to the first object and a second element which is attached to the second object such that the first element and the second element join to affix the first object and the second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Spring: As used in this disclosure, a spring is a mechanical device designed with an elasticity or resilience that allows the mechanical device to store and release mechanical energy by deforming under force and returning to its original shape once the force is removed from the mechanical device.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A boating accessory comprising:

an arcuate shaft, a plurality pair of oar plates and a plurality of fasteners;

wherein the boating accessory is adapted for use with one or more oars;

wherein the one or more oars are attached to the arcuate shaft;

wherein the plurality pair of oar plates are attached to the arcuate shaft;

wherein the plurality of fasteners are attached to the plurality pair of oar plates;

wherein the arcuate shaft comprises a curved bar;

wherein the arcuate shaft is further defined with a first end and a second end;

wherein the first end of the arcuate shaft is formed with a first bevel;

wherein the second end of the arcuate shaft is formed with a second bevel;

wherein the arcuate shaft is a tubular device;

wherein the tubular device has a curvature formed therein;

wherein the curvature of the arcuate shaft forms a spring;

wherein the arcuate shaft further comprises a handle;

wherein the handle is located at the center of the arcuate shaft;

wherein the handle further comprises a first tube, a second tube, and a grip;

wherein the first tube is slid over the arcuate shaft;

wherein the second tube is slid over the arcuate shaft;

wherein the grip is attached to the first tube and the second tube;

wherein the pair of oar plates comprises a first oar plate and a second oar plate;

wherein the first oar plate is a rectangular structure;

wherein the first oar plate is further defined with a first surface and a second surface;

wherein the second oar plate is a rectangular structure;

wherein the second oar plate is further defined with a first surface and a second surface;

wherein the first end of the arcuate shaft is attached to the center of the first surface;

wherein the second end of the arcuate shaft is attached to the center of the third surface;

wherein the first end of the arcuate shaft is attached to the center of the first surface such that the face formed by the first bevel of the first end is attached to the first surface;

wherein the second end of the arcuate shaft is attached to the center of the third surface such that the face formed by the second bevel of the second end is attached to the third surface.

2. The boating accessory according to claim 1 wherein each of the plurality of fasteners attaches the one or more oars to an oar plate selected from the plurality pair of oar plates;

wherein the first fastener is attached to the second surface;

wherein the second fastener is attached to the fourth surface.

3. The boating accessory according to claim 2 wherein the first fastener is a first hook and loop fastener;

wherein the second fastener is a second hook and loop fastener;

wherein the first hook and loop fastener is further defined with a first hook or loop surface and a second hook or loop surface;

wherein the second hook and loop fastener is further defined with a third hook or loop surface and a fourth hook or loop surface.

4. The boating accessory according to claim 3 wherein the first hook or loop surface and the second hook or loop surface are wrapped around the one or more oars and attached together;

wherein the third hook or loop surface and the fourth hook or loop surface are wrapped around the one or more oars and attached together.

5. A boating accessory comprising:

an arcuate shaft, a plurality pair of oar plates and a plurality of fasteners;

wherein the boating accessory is adapted for use with one or more oars;

wherein the one or more oars are attached to the arcuate shaft;

wherein the plurality pair of oar plates are attached to the arcuate shaft;

wherein the plurality of fasteners are attached to the plurality pair of oar plate;

wherein the arcuate shaft comprises a shaft;

wherein the arcuate shaft has an elasticity that causes the arcuate shaft to bow when a load is applied to the first end and the second end;

wherein the arcuate shaft is further defined with a first end and a second end;

wherein the straight shaft has an elasticity that causes the straight shaft to bow when a load is applied to the first end and the second end;

wherein the first end of the arcuate shaft is formed with a first bevel;

wherein the second end of the arcuate shaft is formed with a second bevel;

wherein the arcuate shaft is a tubular device;

wherein the arcuate shaft further comprises a handle;

wherein the handle is located at the center of the arcuate shaft;

wherein the arcuate shaft forms a spring;

wherein the handle further comprises a first tube, a second tube, and a grip;

wherein the first tube is slid over the arcuate shaft;

wherein the second tube is slid over the arcuate shaft;

wherein the grip is attached to the first tube and the second tube;

wherein the pair of oar plates comprises a first oar plate and a second oar plate;

wherein the first oar plate is a rectangular structure;

wherein the first oar plate is further defined with a first surface and a second surface;

wherein the second oar plate is a rectangular structure;

wherein the second oar plate is further defined with a first surface and a second surface;

wherein the first end of the arcuate shaft is attached to the center of the first surface;

wherein the second end of the arcuate shaft is attached to the center of the third surface;

wherein the first end of the arcuate shaft is attached to the center of the first surface such that the face formed by the first bevel of the first end is attached to the first surface;

wherein the second end of the arcuate shaft is attached to the center of the third surface such that the face formed by the second bevel of the second end is attached to the third surface.

6. The boating accessory according to claim 5 wherein each of the plurality of fasteners attaches the one or more oars to an oar plate selected from the plurality pair of oar plates;

wherein the first fastener is attached to the second surface;

wherein the second fastener is attached to the fourth surface.

7. The boating accessory according to claim 6 wherein the first fastener is a first hook and loop fastener;

wherein the second fastener is a second hook and loop fastener;

wherein the first hook and loop fastener is further defined with a first hook or loop surface and a second hook or loop surface;

wherein the second hook and loop fastener is further defined with a third hook or loop surface and a fourth hook or loop surface.

8. The boating accessory according to claim 7 wherein the first hook or loop surface and the second hook or loop surface are wrapped around the one or more oars and attached together;

wherein the third hook or loop surface and the fourth hook or loop surface are wrapped around the one or more oars and attached together.

* * * * *